United States Patent [19]

Chevalier

[11] Patent Number: 4,589,552

[45] Date of Patent: May 20, 1986

[54] PACKAGE COMPRISING A STRIP AND SIDE FLAPS

[76] Inventor: Pierre Chevalier, 31, Boulevard d'Auteuil, Boulogne sur Seine, France, 92100

[21] Appl. No.: 724,836

[22] Filed: Apr. 19, 1985

[30] Foreign Application Priority Data

Apr. 19, 1984 [FR] France ..... 84 06225

[51] Int. Cl.[4] ..... B65D 73/00

[52] U.S. Cl. ..... 206/492; 206/424; 206/461; 206/469; 206/477; 206/485; 229/87 R

[58] Field of Search ..... 206/45.14, 424, 461, 206/469, 476, 477, 482, 485, 492, 216, 232, 491; 229/87 R, DIG. 3

[56] References Cited

U.S. PATENT DOCUMENTS

| | | | |
|---|---|---|---|
| 2,253,770 | 5/1936 | Black | 206/424 |
| 2,274,253 | 2/1942 | Howell | 206/45.14 |
| 2,449,334 | 9/1948 | Smith | 229/87 R |
| 2,846,060 | 5/1958 | Yount | 229/87 R |
| 3,260,359 | 7/1966 | Willhite | 206/492 |
| 3,666,166 | 5/1972 | Freakes | 206/424 |
| 3,847,282 | 11/1974 | Collura et al. | 206/476 |
| 4,300,679 | 11/1981 | Benzschawel et al. | 206/424 |

*Primary Examiner*—Joseph Man-Fu Moy
*Assistant Examiner*—David T. Fidei
*Attorney, Agent, or Firm*—Holman & Stern

[57] ABSTRACT

A package comprises a strip (1) of corrugated cardboard to be wrapped around objects (A) placed on its inside surface. It is provided with two transverse flaps (13, 14) in face-to-face relationship and attached to the inside surface of the strip (1) on two side bands (8, 9) which extend from its longitudinal edges (2, 3) over a distance x, parallel to the longitudinal edges (2, 3) of the strip (1). The strip (1) comprises an end panel (7) which is cut in line with a transverse fold (6) in its central part, meaning that part lying between the two side bands (8, 9). The panel (7) is divided into two flaps (13, 14) by a median longitudinal slit (15). The panel (7) may be folded over the inside surface of the strip (1) by bending it about the transverse fold (6) and fastened to the side bands (8, 9) of the strip (1). The strip (1) is advantageously glued to itself in the transverse direction and to the two flaps (13, 14) when folded against an article in the package.

10 Claims, 10 Drawing Figures

PACKAGE COMPRISING A STRIP AND SIDE FLAPS

BACKGROUND OF THE INVENTION

1. Field of the invention

The invention relates to packages comprising a strip and side flaps.

2. Description of the prior art

There are already known packages made from a strip, generally of corrugated cardboard, and comprising side flaps designed to be bent up and then folded over the objects to be packaged placed on the strip itself.

It is known that a package of this type is particularly advantageous when its shorter sides are inset relative to the general contour of the package, since the packaged objects are in this way better protected against side pressure and impact.

To obtain a package of this kind, one begins with a strip, generally of cardboard, which is cut out in such a way that the flaps are disposed laterally relative to the strip and are folded towards the so-called "inside" surface of the latter, along lines which are aligned with the longitudinal edges of the strip.

A disadvantage of this fabrication process is that it creates waste which cannot be used and is therefore discarded.

To avoid this disadvantage it has already been proposed to utilize a rectangular strip the cutting out of which does not produce any waste, and to fasten on flaps produced by cutting out rectangles from another strip, also without creating any waste.

A package of this type therefore has significant advantages with regard to the consumption of raw material, but it has the disadvantage of requiring the two flaps to be fastened to the strip, entailing the use of non-standard machinery for which the manufacturing, amortization and operating costs reduce the advantage of the low cost of the raw material.

Also, packages of the type indicated hereinabove are generally not provided with integral closure means, and so cannot be used with modern automatic packaging machinery.

The present invention provides for forming the flaps in line with the strip itself, so that there is no significant wastage and the finished package is achieved without fastening on additional parts and as a general rule entails the use of only standard machinery. The invention also provides for utilizing the so-called "inside" surface of the strip to fasten the strip and the flaps and to close the package by joining the inside surface and the outside surface of the strip after enveloping the objects to be packaged.

SUMMARY OF THE INVENTION

The invention consists in a package comprising a strip having an inside surface adapted to receive articles to be packaged and two transverse flaps in face-to-face relationship attached to said inside surface of said strip on two side bands which extend from the longitudinal edges thereof over a defined distance x, parallel to said longitudinal edges of said strip, wherein said strip comprises an end panel which features a transverse fold and is cut in line with said transverse fold in a central part between said side bands and said end panel is divided into two flaps by a median longitudinal slit, whereby said end panel may be folded over said inside surface of said strip by bending it about said transverse fold and fastened to said strip by said side bands.

The strip is advantageously glued to itself in the transverse direction and to the two flaps which are folded against an article in the package.

In accordance with other characteristics of the invention:

- the end panel is narrower than the strip so that when the end panel is folded over there remain two side areas of the strip which are not covered by the end panel;
- the package further comprises at least one element of the same thickness as the strip disposed against the inside surface of the strip outside the area covered by the end panel when folded over;
- the package further comprises two edge flaps folded against and attached to the inside surface of the strip along that part of its longitudinal edges extending to the point where the free edge of the end panel lies when folded over, the edge flaps constituting reinforcements;
- the transverse cut in the end panel comprises two segments between which is defined a central bridge which holds together the two flaps and the end of the strip and which is adapted to be broken when the package is used in order to release the flaps;
- the end panel comprises two notches, one on each side of the longitudinal slit, preferably in face-to-face relationship;
- an adhesive is deposited on the flaps.

Other objects and advantages will appear from the following description of examples of the invention, when considered in connection with the accompanying drawings, and the novel features will be particularly pointed out in the appended claims.

DESCRIPTION OF THE PREFERRED EMBODIMENTS

Figure 1:
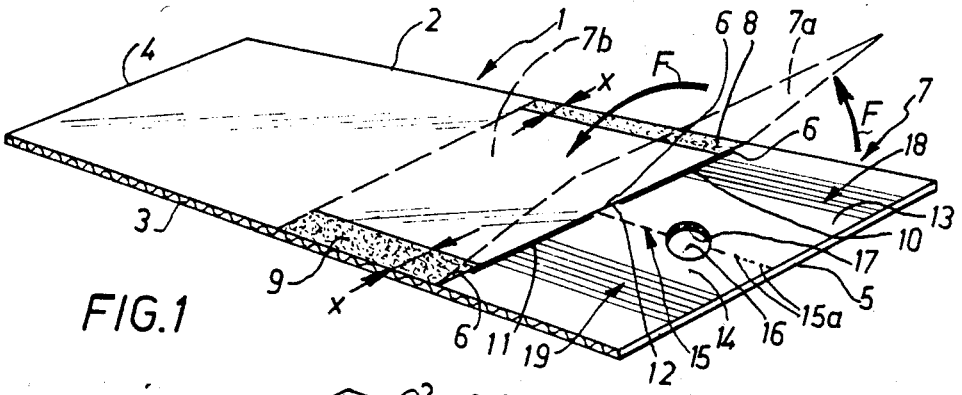
FIG. 1 is a schematic view in perspective showing a package in accordance with the invention designed to be used with a packaging machine.

Referring to FIG. 1, a package in accordance with the invention comprises a corrugated cardboard strip 1 featuring two longitudinal edges 2 and 3 and two ends 4 and 5 perpendicular to the edges 2 and 3, such that the strip has a perfectly rectangular contour.

This strip is marked by a transverse fold line 6 which delimits with the longitudinal edges 2 and 3 and the end 5 a panel 7.

The latter is cut transversely in line with the fold line 6 in its central part between two bands 8 and 9 of width x parallel to the longitudinal edges 2 and 3. In this instance, this cut comprises two segments 10 and 11 which leave a narrow central bridge 12.

The panel 7 is divided into two flaps 13 and 14 by a median longitudinal slit 15 on opposite sides of which are two notches 16 and 17 in face-to-face relationship. The two flaps 13 and 14 are held together by non-slit parts or bridges 15*a*.

Score lines 18 and 19 parallel to one another and to the length of the strip 1 are formed in the flaps 13 and 14.

The panel 7 is intended to be folded along the line 6 and then folded over the so-called "inside" surface of the strip 1, as shown by the arrows F and as indicated in dashed line showing an intermediate folded position 7*a* and the final position 7*b* with the panel 7 applied against the inside surface of the strip 1.

Before the panel 7 is folded over, an adhesive must be disposed along the two lateral bands 8 and 9, either on the strip as shown in FIG. 1 or on the panel 7.

The folding over of the panel 7 as shown by the arrows F may be carried out in two different ways:

If the user has a packaging machine, the finished article supplied to him may be as shown in FIG. 1, with the panel 7 not folded over and the adhesive being either not applied or not operative. These packages are stacked in the machine and the first phase of the packaging operation consists in rendering the adhesive operative (deposit of adhesive or removal of a protective strip laid over an adhesive previously deposited either on the strip 1 or on the panel 7) on the two lateral bands 8 and 9 and to fold the panel 7 over as shown by the arrows F. The objects are then packaged as described later.

Figure 2:
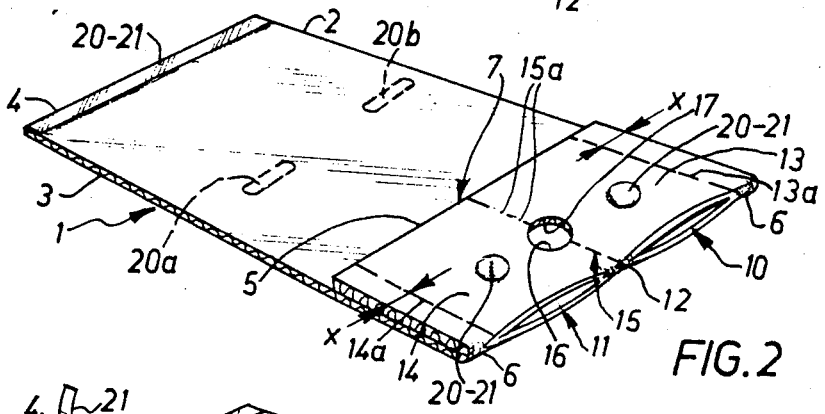
FIG. 2 is a schematic view in perspective showing a package in accordance with the invention ready to receive objects to be packaged.

If the user is packaging manually, the finished article supplied to him may be that shown in FIG. 2, with the panel 7 folded over against the strip 1 and held along the two lateral bands 8 and 9 by adhesive either on the strip 1 or on the panel 7. The user packages the objects as described later.

FIG. 2 shows that in reality, after the panel 7 is folded over, the fold line 6 is reduced to two end segments and that which is in the bridge 12.

For greater clarity the degree to which the cuts 10 and 11 open has been exaggerated, as this makes it clear that the flaps 13 and 14 are joined to one another and in combination to the strip 1 by the bridge 12.

Figure 3:
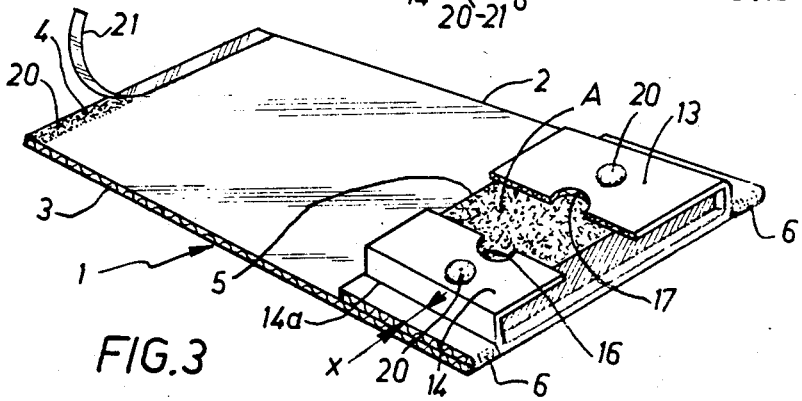
FIG. 3 is a schematic view in perspective showing the utilization of the package of FIG. 2.
Figure 4:
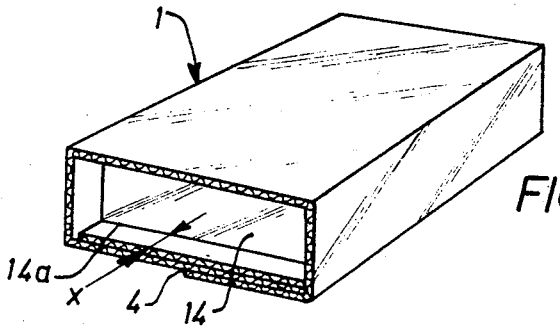
FIG. 4 is a schematic view showing the package of FIGS. 2 and 3 when completed, enveloping an object and closed.

Referring to FIGS. 3 and 4, it is seen that to package a number of objects A the notches 16 and 17 are employed, either manually or mechanically, to break the bridges 15*a* and raise the flaps 13 and 14 along the fold lines 13*a* and 14*a* provided substantially in line with the inside boundary of the adhesive bands 8 and 9.

The object or objects A are then placed directly on the inside surface of the strip 1 and the flaps 13 and 14 are folded over the object or objects A, folding along one of the score lines 18 and 19 according to the thickness of the object or objects A, in the manner known per se. This situation is schematically represented in FIG. 3 and is brought about whether packaging is mechanized or manual.

An adhesive 20 such as glue is deposited near the edge 4 of the inside surface of the strip 1 and on the flaps 13 and 14. When a packaging machine is used, the glue may be deposited automatically, by any known means, along continuous lines or at spaced points. In manual operation it may be advantageous to provide a "self-adhesive" type adhesive 20 entailing the presence of a protective strip 21, in the manner well known per se.

The strip 1 is then folded about a transverse line, either manually or mechanically, as near as possible the edge 5, and the enveloping of the object or objects A is continued until the configuration of FIG. 4 is achieved, representing the finished package. When the adhesive 20 is associated with a protective strip 21, this strip 21 is removed to expose the adhesive 20. The finished package is held closed by two conjugate means:

on the one hand the strip 1 holds the flaps 13 and 14 in place, irrespective of the thickness of the objects A to be packaged;

on the other hand the strip 1 is fastened to itself, also irrespective of the thickness of the objects A to be packaged.

The package thus obtained totally avoids movement of the objects and the possibility of the flaps 13 and 14 becoming deformed in consequence of this. It therefore provides a degree of protection previously unknown.

Nevertheless, it is economic and simple.

With particular reference to FIG. 1, it is seen that the package is of perfectly rectangular shape, without any additional thickness portion or any projecting portion.

By design, this is the most economic of packages in one piece of the type comprising side flaps with security edges (distance x) and adaptable to objects of variable height.

The folding over of the panel 7 affects part only of the strip 1, so that the latter may be held by its other part, by mechanisms of fabrication and packaging machines, etc.

The deposition of the adhesive 20 on the flaps 13 and 14 after the flap 7 is folded over is carried out from the same side as that near the edge 4, and consequently without complicating the machinery.

The adhesive intended to fasten together the strip 1 and the flaps 13 and 14 may be deposited either on the flaps 13 and 14 themselves or on the inside surface of the strip 1, more or less at the places referenced 20*a* and 20*b* on FIG. 2. This latter solution may be advantageous because the three locations 20, 20*a* and 20*b* are situated at the same and invariable level on the inside surface of the strip 1.

When the package is closed mechanically, the adhesive is of the immediate action type, such as a glue the composition and deposition of which are perfectly well understood by the man skilled in the art.

As is known, a package of this kind may be used to wrap one or more objects A of different thicknesses since the flaps 13 and 14 may be folded at exactly the required height along one of their score lines 18 and 19 and because the part of the strip 1 situated between the end 4 and the edge 5 folds at the required place to surround the combination formed by the packaged objects A, the folded over flaps 13 and 14 and the bottom of the strip 1 serving as a base.

Thus the end 4 is applied against different locations on the bottom surface of the package (as is seen in FIG. 4) according to the thickness of the objects A, and the adhesive 20 enables it to be fastened at any location whatever on this surface.

The packages shown in FIGS. 1 through 4 require somewhat special machinery since the standard machines generally comprise longitudinal conveyor belts which bear on the packages in the vicinity of their edges 2 and 3 and which would oppose the folding of the panel 7 about the transverse line 6.

Figure 5:
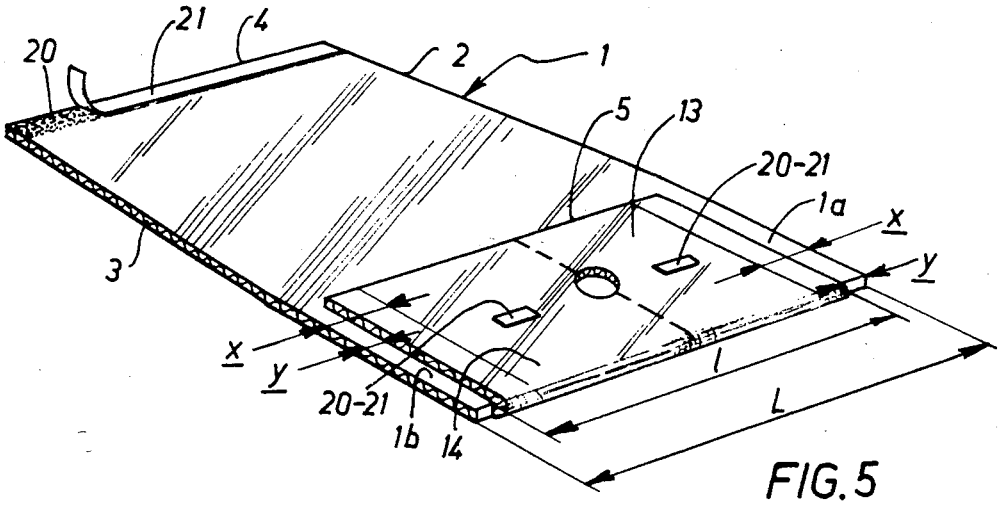
FIG. 5 shows one specific embodiment of a package of the same type as that of FIG. 2 by virtue of which standard machines may be used for its fabrication.

To permit standard machinery to be used the embodiment of FIG. 5 may be adopted.

This package is characterized by the fact that the panel 7 is narrower than the strip 1, by virtue of cut-outs a few millimeters wide in the lateral areas 1*a* and 1*b* of the strip 1. The width y of these areas is such that the remaining width l of the panel 7 is less than the width L of the strip 1 and therefore less than the distance between the edges of the belts situated face-to-face. Thus the belts are operative over all the length of the package (strip 1 proper and areas 1*a* and 1*b*) while permitting the panel 7, situated entirely between the belts, to be folded without impediment.

After folding over the panel 7, the areas 1*a* and 1*b* remain exposed and the belts of the machine continue to fulfil their guiding and entrainment function.

Material is removed over the width y only within the width x where the flaps 13 and 14 are glued to the strip 1, and this has no deleterious consequences with regard to the retention of the flaps 13 and 14, given the effectiveness of modern adhesives.

Figure 6:
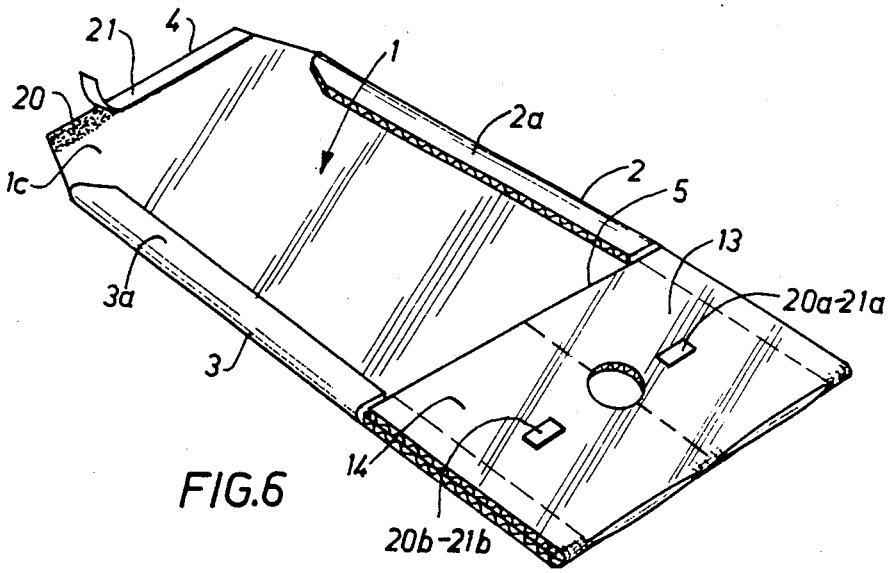
FIG. 6 shows an embodiment of the package in accordance with the invention specifically intended for the manual packaging of objects.

The package of FIG. 6 is characterized by the fact that the edges 2 and 3 of the strip 1 comprise reinforcements 2*a* and 3*a* consisting of edge flaps of the strip 1 folded over onto the inside surface of the latter, along the edges 2 and 3, and held in place by an adhesive deposited at the same time as that on the bands 8 and 9.

The edge flaps extend as far as the immediate vicinity of the edge 5 after the panel 7 is folded over. There are thus two small waste sections consisting of the part cut away from the edge flaps 2*a* and 3*a* which previously extended along the full length of the strip 1 before the panel 7 is folded.

Before they are folded, the edge flaps 2*a* and 3*a* project beyond the width of the panel 7 and cooperate with the conveyor belts of the machine, as explained above. The package is thus appropriately held and guided. The panel 7, situated between these belts, can once again be folded transversely against the strip 1 without impediment.

The edge flaps 2*a* and 3*a* are then folded in turn, but longitudinally in this instance, against the strip 1, in the manner known to those skilled in the art. They are preferably held in place by an adhesive previously deposited at the appropriate locations.

After they are folded over, the edge flaps 2*a* and 3*a* lie within the contour of the strip 1 and constitute reinforcements which offer better protection to the packaged objects.

The edge flaps 2*a* and 3*a* do not extend as far as the edge 4 since the strip 1 is cut with a slight taper to form a sort of transverse tab 1*c* once again provided with an adhesive 20 and a protective strip 21 along the edge 4.

Figure 7:
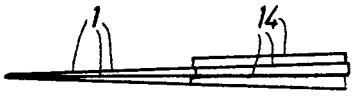
FIGS. 7 and 8 are schematic views showing the different presentation of two types of package in accordance with the invention when stacked.

The packages of the types of FIGS. 2, 3 and 5 as delivered to the client feature double thickness at the location of the flaps 13 and 14. When they are stacked, they appear when seen from the side as shown in FIG. 7. This asymmetric disposition is acceptable when the packages are to be used manually. Initially, for purposes of delivery, they may be stacked head-to-tail in groups, to compensate for this rotation. When subsequently used, the operator may remove them from the stack one by one without difficulty.

This does not apply when the packages must be used in a machine. In practice, neither rotation nor alternate presentation are feasible.

For this reason the package of FIG. 6 is preferable when it is to be filled mechanically.

Figure 8:
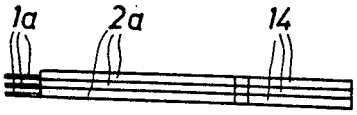

This package has edge flaps 2*a*–3*a* folded over along the edges 2 and 3 only and not on the panel 7, so that the same thickness (twice that of the original material) is obtained over virtually all the length of the strip 1 and the packages stack horizontally, all with the same orientation, as shown in FIG. 8.

The same obviously applies to the packages of the type shown in FIG. 1, which is of single thickness all over.

Figure 9:
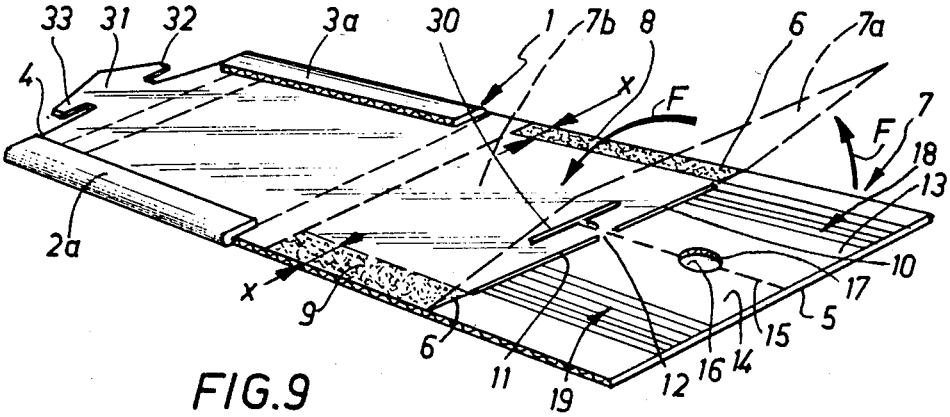
FIG. 9 is a schematic representation of an embodiment of the invention adapted to packaging objects the thickness of which is known in advance.
Figure 10:
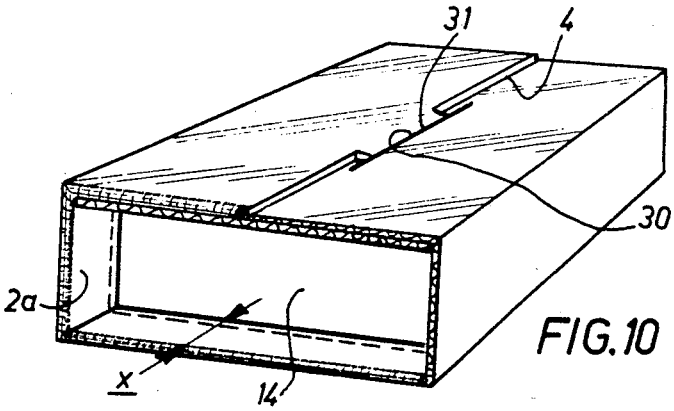
FIG. 10 is a schematic view in perspective of the package of FIG. 9 finished and closed.

If the package is used for a series of one or more objects having a constant thickness, an external closure system other than an adhesive may be used, such as that shown in FIGS. 9 and 10.

FIG. 9 shows a package in the same situation as that of FIG. 1, and the same component parts bear the same reference numbers.

In this instance, the part of the strip 1 which must be covered by the folded over panel 7 comprises a slit 30 and a closure tab 31 is provided at the end 4 of the strip 1.

After the package is made up, and thus after the panel 7 is folded over onto the strip 1 and glued on by virtue of the adhesive bands 8 and 9, the process is as explained hereinabove but since the thickness of the objects to be packaged is known, the end 4 of the strip 1 is always at the same position relative to the side on which it is disposed after wrapping, such that the tab 31 enters the slit 30 in which it is locked by tangs 32 and 33, as known per se.

Any other closure system may naturally be adopted.

FIG. 9 shows a variation which consists in providing reinforcements 2*a* and 3*a* for the reason that packaging objects of invariable dimensions is particularly suitable for mechanisation and it is consequently better to provide this type of package with means enabling it to be stacked flat, after folding over the panel 7, as shown in FIG. 8.

Naturally it will also be possible to provide means other than the edge flaps 2*a* and 3*a* for doubling the thickness of the strip 1 outside the location of the flaps 13 and 14. A flap situated along the edge 4 could be folded transversely over the inside surface of the strip 1, for example.

Here again, however, use may be made of a single thickness package when the panel 7 is not folded over until the package is filled. In this way no means for compensating for the thickness of the panel 7 (such as the edge strips 2*a* and 3*a*) are needed.

The fabrication of a package in accordance with the invention does not produce any significant waste and is more rational than that of known packages of the same type.

For given dimensions of the objects to be packaged, the package in accordance with the invention is more economic:

- if the strip 1 is of a material supplied on spools, narrower spools may be employed to produce the same number of packages;
- if the strip 1 is of a material supplied in sheet form (in particular "double-skinned" corrugated cardboard), more packages are obtained per unit surface area.

For example, if the machines available accept sheets 150 cm wide and a package 51 cm wide is required, only two packages may be obtained side by side, with 48 cm of wastage. As the package in accordance with the invention is narrower than those of the prior art, more than two may be placed within the same width, commensurately reducing the residual wastage. If no more than 2 cm of width were saved, it would still be possible to place side by side three 49 cm wide packages instead of two 51 cm packages, reducing the wastage from 48 cm to 3 cm, achieving a 50% increase in package production from the same quantity of raw material.

A significant saving is achieved in this way and it has been estimated that to obtain a package of given dimensions and ffeaturing flaps (13–14) of the same dimensions, a known type package would required up to 40 or 50% more cardboard, depending on the format in question.

Standard so-called "folding and glueing" machines enable packages in accordance with the invention to be fabricated, as well as other products, and equip most workshops in which boxes cut out from cardboard are manufactured. The simplicity with which packages in accordance with the invention are fabricated further enables these machines to be operated at a faster throughput to obtain a still lower unit cost.

It will be understood that various changes in the details, materials and arrangements of parts which have been herein described and illustrated in order to explain the nature of the invention may be made by those skilled in the art within the principle and scope of the invention as expressed in the appended claims.

There is claimed:

1. Package comprising a strip having an inside surface adapted to receive articles to be packaged and two transverse flaps in face-to-face relationship attached to said inside surface of said strip on two side bands which extend from the longitudinal edges thereof over a defined distance x, parallel to said longitudinal edges of said strip, wherein said strip comprises an end panel which features a transverse fold and is cut in line with said transverse fold in a central part between said side bands and said end panel is divided into two flaps by a median longitudinal slit, whereby said end panel may be folded over said inside surface of said strip by bending it about said transverse fold and fastened to said strip by said side bands.

2. Package according to claim 1, wherein said strip is glued to itself in the transverse direction and to said two flaps which are folded against an article in the package.

3. Package according to claim 1, wherein said end panel is narrower than said strip so that when said end panel is folded over there remain two side areas of said strip which are not covered by said end panel.

4. Package according to claim 1, further comprising at least one element of the same thickness as said strip disposed against said inside surface of said strip outside the area thereof covered by said end panel when folded over.

5. Package according to claim 3, further comprising two edge strips folded against and attached to said inside surface of said strip along that part of its longitudinal edges extending to the point where the free edge of said end panel lies when folded over, said edge strips constituting reinforcements.

6. Package according to claim 1, wherein said transverse cut in said end panel comprises two segments between which is defined a central bridge which holds together said two flaps and the end of said strip and which is adapted to be broken when said package is used in order to release said flaps.

7. Package according to claim 1, wherein said end panel comprises two notches, one on each side of said longitudinal slit.

8. Package according to claim 7, wherein said notches are in face-to-face relationship.

9. Package according to claim 1, wherein an adhesive is deposited on said flaps.

10. Package according to claim 1, wherein said strip is of corrugated cardboard.

* * * * *